US008342733B2

(12) United States Patent
Daily et al.

(10) Patent No.: US 8,342,733 B2
(45) Date of Patent: Jan. 1, 2013

(54) LED LIGHTING ASSEMBLIES

(75) Inventors: Christopher George Daily, Harrisburg, PA (US); Rohan Narang, Harrisburg, PA (US); Matthew Edward Mostoller, Hummelstown, PA (US); Ronald Martin Weber, Annville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 480 days.

(21) Appl. No.: 12/637,356

(22) Filed: Dec. 14, 2009

(65) Prior Publication Data

US 2011/0140136 A1 Jun. 16, 2011

(51) Int. Cl.
*H01R 33/00* (2006.01)

(52) U.S. Cl. ..... 362/646; 362/249.01; 362/249.02; 362/652; 439/558

(58) Field of Classification Search ..... 362/249.01, 362/249.02, 555, 640, 646, 652; 439/76.1, 439/555, 558
See application file for complete search history.

(56) References Cited

U.S. PATENT DOCUMENTS

| | | | | |
|---|---|---|---|---|
| 6,837,598 | B2 * | 1/2005 | Marcus | 362/374 |
| 7,036,962 | B2 * | 5/2006 | Chan | 362/407 |
| 7,540,761 | B2 * | 6/2009 | Weber et al. | 439/487 |
| 7,549,786 | B2 * | 6/2009 | Higley et al. | 362/646 |
| 7,758,223 | B2 * | 7/2010 | Osawa et al. | 362/547 |
| 7,976,335 | B2 * | 7/2011 | Weber et al. | 439/487 |
| 8,083,381 | B2 * | 12/2011 | Tsai | 362/311.02 |
| 8,092,045 | B2 * | 1/2012 | Xiao et al. | 362/249.02 |
| 2009/0170361 | A1 | 7/2009 | Daily et al. | |

FOREIGN PATENT DOCUMENTS

| | | |
|---|---|---|
| DE | 20 2008 004620 | 6/2008 |
| DE | 20 2008 006327 | 7/2008 |
| WO | WO 2008/133889 | 11/2008 |

OTHER PUBLICATIONS

European Search Report, Mail Date Mar. 30, 2011, EP 10 19 4801, Application No. 10194801.6-2423.

* cited by examiner

*Primary Examiner* — John A Ward

(57) ABSTRACT

A lighting assembly for a light emitting diode (LED) package having an LED chip on the top of a mounting substrate with power leads on the top of the mounting substrate arranged proximate to a first edge of the mounting substrate, which is mounted to a base, includes power contacts defining separable interfaces for contacting the power leads on the mating substrate of the LED package and supplying power to the LED chip. The power contacts have compliant beams extending to the separable interfaces that are deflected when contacting the power leads such that the power contacts are biased against the power leads. The power contacts are terminated to corresponding power conductors opposite the separable interfaces. The lighting assembly also includes a dielectric housing holding the power contacts, with the housing having mounting features for securing the housing to the base independent of the LED package.

20 Claims, 12 Drawing Sheets

LED LIGHTING ASSEMBLIES

BACKGROUND OF THE INVENTION

The subject matter herein relates generally to solid state lighting, and more particularly, to connectors for lighting assemblies.

Solid-state light lighting systems use solid state light sources, such as light emitting diodes (LEDs), and are being used to replace other lighting systems that use other types of light sources, such as incandescent or fluorescent lamps. The solid-state light sources offer advantages over the lamps, such as rapid turn-on, rapid cycling (on-off-on) times, long useful life span, low power consumption, narrow emitted light bandwidths that eliminate the need for color filters to provide desired colors, and so on. LED lighting systems typically include LED packages that have a substrate with power leads on the substrate connected to an LED chip. A lens surrounds the LED chip, and light is emitted by the LED through the lens.

The LED packages typically have power leads that are soldered to pads on a printed circuit board (PCB) to make an electrical and mechanical connection to the PCB. The power leads are arranged on the bottom of the substrate of the LED packages for such connections. Some known lighting systems use sockets to hold the LED packages, where the sockets have power contacts that contact corresponding power leads on the LED package. The power leads are typically on the sides of the substrate of the LED package for such connections. Because of the heat generated by LED packages, it is desirable to use a heat sink to dissipate heat from the LED packages. Heretofore, LED manufacturers have had problems designing a thermal interface that efficiently dissipates heat from the LED package because the power leads are arranged along the bottom and/or the sides of the substrate. Some LED manufacturers are creating LED packages that have power leads on the top of the substrate, to allow the thermal interface to be positioned along the bottom and/or sides of the substrate. However, as the size of LED packages decreases, problems arise with being able to connect the power leads to power conductors. Known LED packages of such configurations have had wires soldered to the power leads. Such connections are difficult, time consuming, and are not well adapted for automation.

Additionally, some known LED packages are integrating multiple LED chips, such as for multiple color effects. Each LED chip needs separate power leads. As such, the power leads are made smaller, so as to fit many power leads on the top of the substrate. Terminating power conductors to such leads by way of soldering is very difficult and uneconomical.

A need remains for lighting systems that can be powered efficiently. A need remains for lighting systems with LED packages that have adequate thermal dissipation. A need remains for lighting systems with LED packages that are assembled in an efficient and cost-effective manner.

BRIEF DESCRIPTION OF THE INVENTION

In one embodiment, a lighting assembly is provided for a light emitting diode (LED) package having an LED chip on the top of a mounting substrate with power leads on the top of the mounting substrate arranged proximate to a first edge of the mounting substrate. The mounting substrate is mounted to a base. The lighting assembly includes power contacts defining separable interfaces for contacting the power leads on the mating substrate of the LED package and supplying power to the LED chip. The power contacts have compliant beams extending to the separable interfaces that are deflected when contacting the power leads such that the power contacts are biased against the power leads. The power contacts are terminated to corresponding power conductors opposite the separable interfaces. The lighting assembly also includes a dielectric housing holding the power contacts, with the housing having mounting features for securing the housing to the base independent of the LED package.

In another embodiment, a lighting assembly is provided for a LED package having an LED chip on the top of a mounting substrate with power leads on the top of the mounting substrate arranged proximate to a first edge of the mounting substrate, which is mounted to a base. The lighting assembly includes power contacts each having a first mating portion and a second mating portion. The first mating portion defining a separable interface for contacting a corresponding power lead on the mating substrate of the LED package and supplying power to the LED chip. The second mating portion is terminated to a corresponding power conductor opposite the separable interface. A dielectric housing holds the power contacts and includes an upper portion holding the first mating portions of the power contacts and a lower portion holding the second mating portions of the power contacts. The upper portion is secured to the base adjacent the LED package, and the lower portion extends from the upper portion through an opening in the base. The lower portion has a port being configured to receive the power conductors for mating with the second mating portions of the power contacts.

In a further embodiment, a lighting assembly is provided for a light emitting diode (LED) package having an LED chip on the top of a mounting substrate with power leads on the top of the mounting substrate arranged proximate to a first edge of the mounting substrate, which is mounted to a base. The lighting assembly includes power contacts each having a first mating portion and a second mating portion. The first mating portions define separable interfaces for contacting corresponding power leads on the mating substrate of the LED package and supplying power to the LED chip. The first mating portions have compliant beams extending to the separable interfaces that are deflected when contacting the power leads such that the power contacts are biased against the power leads. The second mating portions have insulation displacement contacts (IDCs) for terminating to corresponding power conductors of power supply wires. A dielectric housing holds the power contacts and has mounting features for securing the housing to the base independent of the LED package.

DETAILED DESCRIPTION OF THE INVENTION

Figure 2:
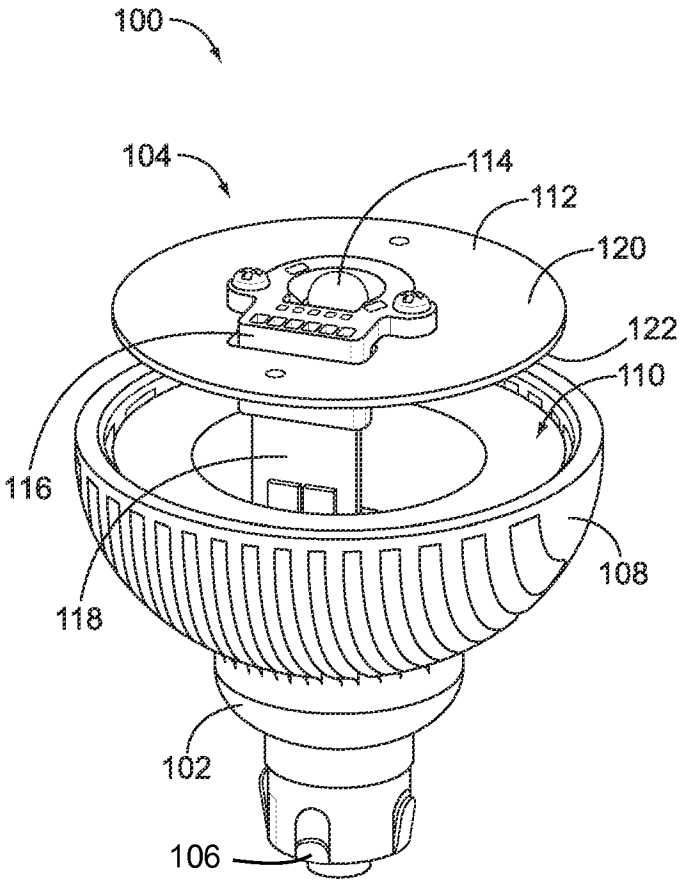
FIG. 2 is an exploded view of the lighting fixture shown in FIG. 1.
Figure 1:
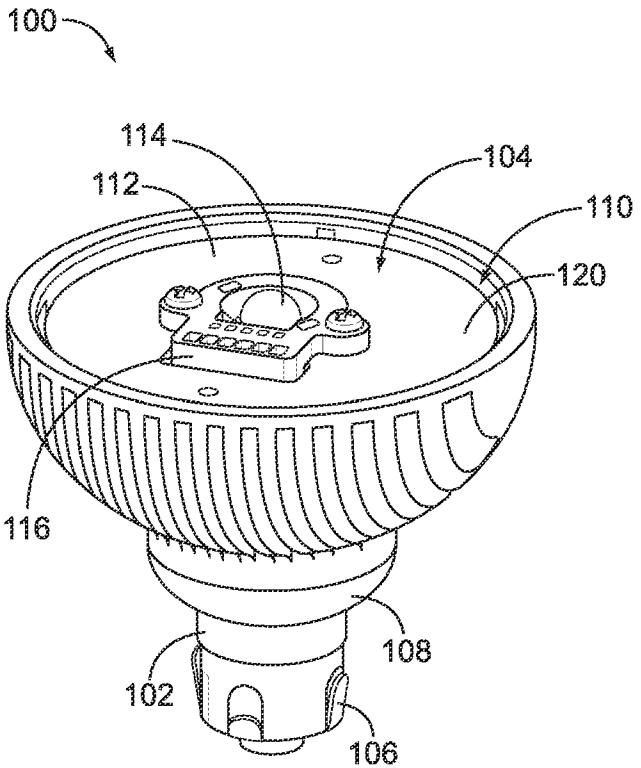
FIG. 1 is a top perspective view of a lighting fixture formed in accordance with an exemplary embodiment.

FIG. 1 is a top perspective view of a lighting fixture 100 formed in accordance with an exemplary embodiment. FIG. 2 is an exploded view of the lighting fixture 100. The lighting fixture 100 includes a lighting ballast 102 and a lighting assembly 104. The lighting assembly 104 is received in the lighting ballast 102 for producing a lighting effect. While the lighting fixture 100 is illustrated as a bulb type fixture, it is realized that the lighting fixture 100 may have other configurations as well, such as a tube configuration. The lighting fixture 100 may be used for residential, commercial or industrial use. The lighting fixture 100 may be used for general purpose lighting, or alternatively, may have a customized application or end use.

The lighting ballast 102 includes power conductors 106 at an end thereof that is configured to receive power from a power supply. The lighting ballast includes a frame 108 configured to hold the power conductors 106 and the lighting assembly 104. The power conductors 106 are electrically coupled to the lighting assembly 104 to supply power to the lighting assembly 104. The lighting ballast 102 includes a recess 110 that receives the lighting assembly 104. Optionally, the lighting ballast 102 may include a lens (not shown) attached to the top of the frame 108 that covers the lighting assembly 104. The light is directed through the lens.

The lighting assembly 104 includes a base 112, a light emitting diode (LED) package 114 mounted to the base 112, and a power connector 116 mounted to the base 112, and a power supply connector 118 coupled to the power connector 116. The power supply connector 118 receives power from a power supply, such as from the power conductors 106. The power supply connector 118 supplies power to the power connector 116. The power connector 116 supplies power to the LED package 114.

The base 112 includes a top surface 120 and a bottom surface 122. The LED package 114 and the power connector 116 are mounted to the top surface 120. In an exemplary embodiment, the LED package 114 is secured to the base 112 separate from the power connector 116. For example, the LED package 114 may be soldered to the base 112. The power connector 116 is coupled to the LED package 114 after the LED package 114 is mounted to the base 112 in a separate assembly step. The power connector 116 makes contact with the LED package 114 at a separable interface.

Optionally, the base 112 may represent a heat sink. The LED package 114 and/or the power connector 116 may be in thermal contact with the base 112 such that the base 112 may dissipate heat from the LED package 114 and/or the power connector 116. Optionally, the base 112 may be a printed circuit board (PCB). The PCB may include a heat sink therein, such as one or more layers defining a heat sink to dissipate heat from the LED package 114 and/or the power connector 116.

Figure 3:
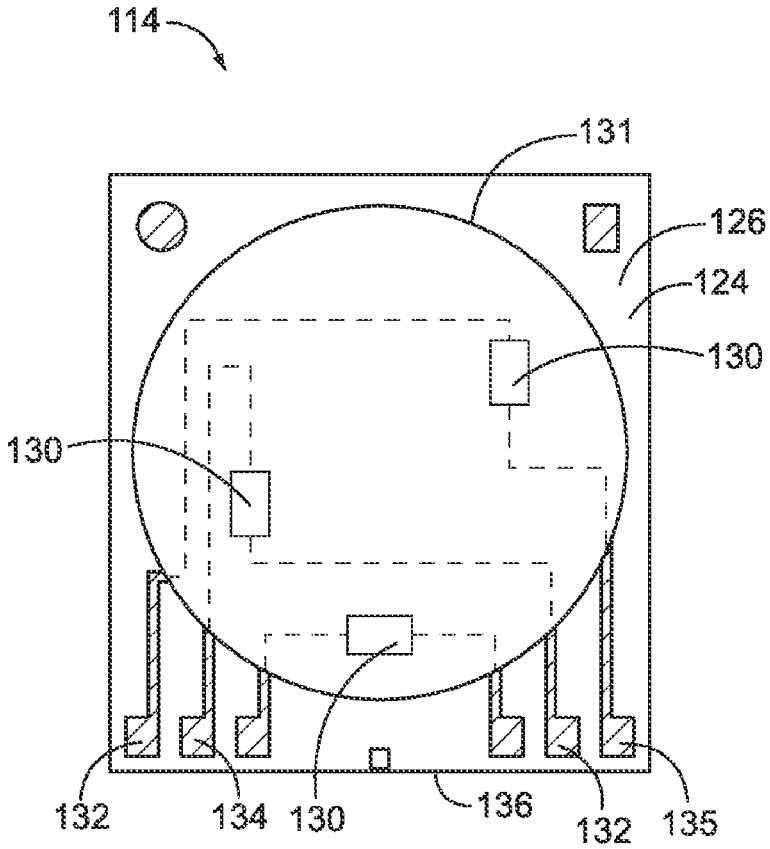
FIG. 3 is a top view of a LED package for the lighting fixture shown in FIG. 1.
Figure 4:
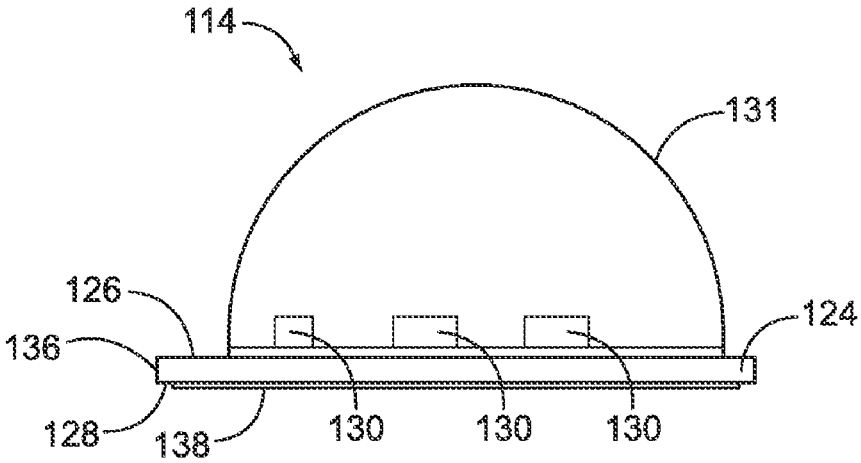
FIG. 4 is a side view of the LED package shown in FIG. 3.

FIG. 3 is a top view of the LED package 114. FIG. 4 is a side view of the LED package 114. The LED package 114 includes a mounting substrate 124 having a top 126 and a bottom 128. The LED package 114 has one or more LED chip(s) 130 mounted on the top 126 of the mounting substrate 124. A lens 131 covers the LED chips 130 and other circuitry and/or circuit components. Optionally, a reflector (not shown) may be provided in addition to the lens 131.

Power leads 132 are also provided on the top 126 of the mounting substrate 124 and electrically connected to corresponding LED chips 130. The power leads 132 may be pads and/or conductive traces extending on one or more layers of the mounting substrate 124. In the illustrated embodiment, three LED chips 130 are provided, with each LED chip 130 corresponding to a different color (e.g. red, green, blue, and the like). Two power leads 132 are provided for each LED chip 130, representing an anode power contact 134 and a cathode power contact 135, resulting in a total of six power leads 132 on the top 126. It is realized that any number of LED chips 130 and corresponding power leads 132 may be provided in alternative embodiments. When the power leads 132 are powered, the LED chips 130 are activated, causing the LED package 114 to emit light. Different combinations of LED chips 130 may be powered to have different lighting effects.

In the illustrated embodiment, the power leads 132 are arranged only on the top 126, and are not provided on the bottom 128 or any of the edges 136. The power leads 132 are arranged proximate to one edge 136 of the mounting substrate 124 in a row, however other arrangements are possible in alternative embodiments. Because no power leads 132 are arranged on the edges 136, the mounting substrate 124 may be relatively thin, reducing the profile and/or allowing the LED chips 130 to be relatively close to the bottom 128. Because no power leads 132 are arranged on the bottom 128, the entire, or substantially the entire, bottom 128 may include a thermal component 138 therein.

The thermal component 138 may be a thermal layer, a thermal grease, a thermal epoxy, a thermal pad, solder paste, or another type of thermal component. When the LED package 114 is mounted to the base 112 (shown in FIGS. 1 and 2), the thermal component 138 represents a thermal interface for the LED package 114. The LED package 114 may efficiently dissipate heat through the thermal component 138 to the base 112, which may include a heat sink in the area of the thermal component 138. In an exemplary embodiment, the thermal component 138 covers the entire area of the bottom 128 vertically below the lens 131. The thermal component 138 may extend beyond the perimeter of the lens 131 and cover more of the mounting substrate 124, such as the area vertically below the power leads 132.

Figure 5:
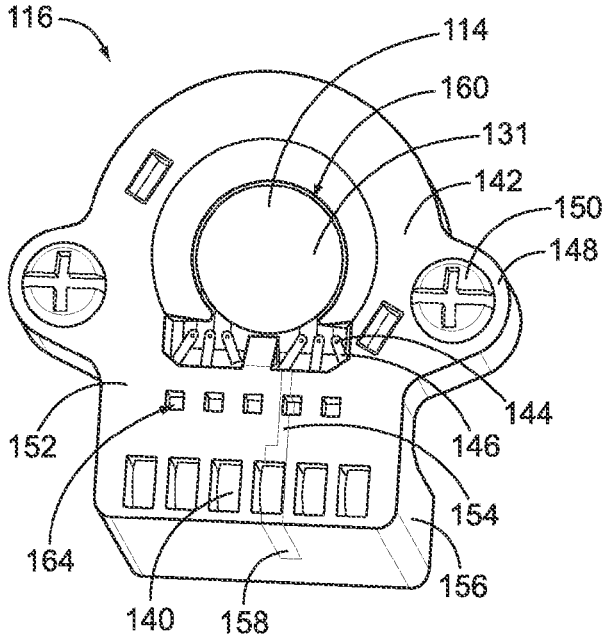
FIG. 5 is a top view of an exemplary power connector for the lighting fixture shown in FIG. 1 mated with the LED package shown in FIG. 3.
Figure 6:
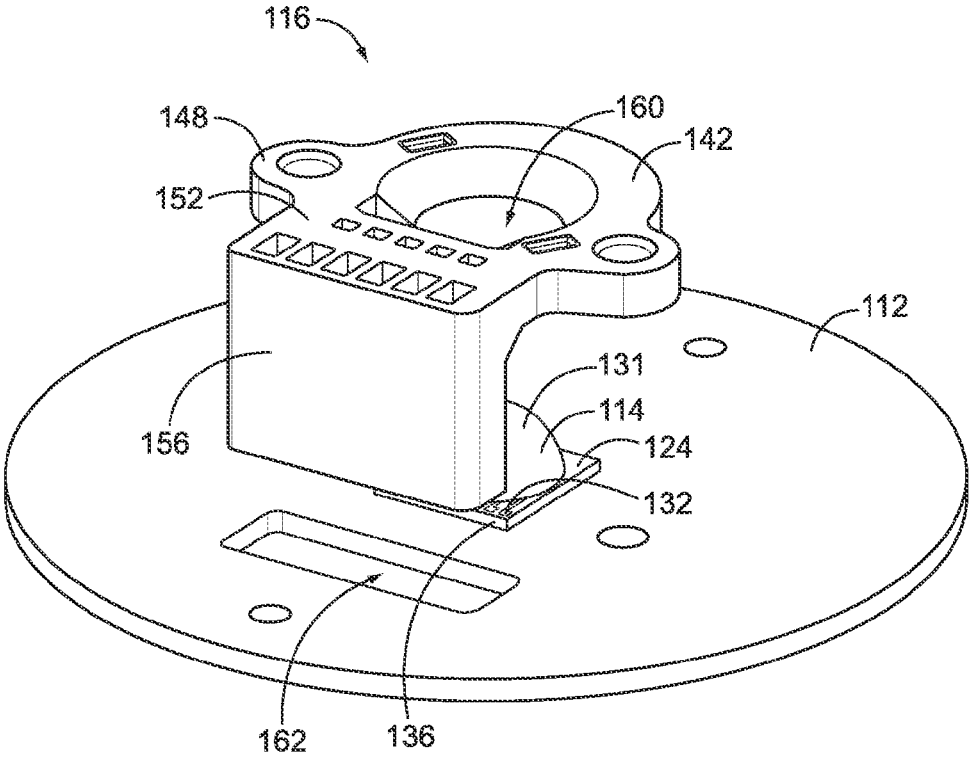
FIG. 6 is an exploded view of the power connector shown in FIG. 5.

FIG. 5 is a top view of an exemplary power connector 116 mated with the LED package 114 (portions shown in phantom). FIG. 6 is an exploded view of the power connector 116. The power connector 116 includes power contacts 140 held within a dielectric housing 142. The power contacts 140 define separable interfaces 144 for contacting the power leads 132 on the mating substrate 124 of the LED package 114. The power contacts 140 supply power to the LED package 114 and the corresponding LED chips 130 (shown in FIGS. 3 and 4). The power contacts 140 include compliant beams 146 extending to the separable interfaces 144. The compliant beams 146 are deflected when the power connector 116 is mated to the LED package 114 and when contacting the power leads 132 such that the power contacts 140 are biased against the power leads 132 to ensure electrical contact therebetween. Optionally, the complaint beams 146 may be cantilevered from the housing 142. The separable interfaces 144 of the power contacts 140 are arranged in a row on one side of the LED package 114 to contact the power leads 132 at the edge 136 of the mounting substrate 124 (both shown in FIG. 6). In an exemplary embodiment, the power contacts 140 are grouped in two groups with each group having a plurality of power contacts 140. One group defines anode power contacts supplying a positive voltage to the corresponding power leads 132. The other group defining cathode power contacts supplying negative voltage to the corresponding power leads 132. Each anode power contact 140 is configured to contact a discrete power lead 132, and each cathode power contact 140 is configured to contact a discrete power lead 132.

The housing 142 includes mounting features 148 for securing the housing 142 to the base 112 independent of the LED package 114. In the illustrated embodiment, the mounting features 148 are represented by ears that have openings that receive fasteners 150. Other types of mounting features 148 may be used in alternative embodiments, such as pegs, latches, solder pads, and the like.

The housing 142 includes an upper portion 152 holding a first mating portion 154 (portions shown in phantom in FIG. 5) of each power contact 140. The housing 142 also includes a lower portion 156 holding a second mating portion 158 (portions shown in phantom in FIG. 5) of each power contact 140. The upper portion 152 is secured to the base 112 adjacent the LED package 114. The upper portion 152 includes an opening 160 that receives the lens 131 of the LED package 114. The sides of the opening 160 may be tapered so that the housing 142 does not block light emitted from the lens 131. The lower portion 156 extends from the upper portion 152 through an opening 162 in the base 112. As such, the lower portion 156 is exposed beneath the base 112, such as for mating with the power supply connector 118 (shown in FIG. 2) beneath the base 112. Optionally, the lower portion 156 may extend approximately perpendicular from the upper portion 152, giving the housing 142 an L-shape. The second mating portions 158 of the power contacts 140 are bent approximately 90° to define right angle contacts. The second mating portions 158 may extend along a majority of the lower portion 156.

In an exemplary embodiment, the housing 142 includes punch-out windows 164. The punch-out windows 164 are configured to receive a tool (not shown) that removes portions of the power contacts 140. For example, in an exemplary embodiment, the power contacts 140 are stamped and formed as part of a lead frame, wherein each of the power contacts 140 are integrally formed from a common sheet of metal material. The power contacts 140 remain attached to one another during manufacture of the housing 142. For example, the housing 142 may be overmolded over the power contacts 140. By having the power contacts 140 connected to one another during the overmolding process, the relative positions of the power contacts 140 with respect to one another and with respect to the housing 142 may be accurately maintained. After the housing 142 is formed, the power contacts 140 need to be separated from one another to define discrete power contacts 140. The tool is inserted into the punch-out windows 164 and the connecting pieces that connect the power contacts 140 is removed, thus isolating the power contacts 140 from one another.

Figure 7:
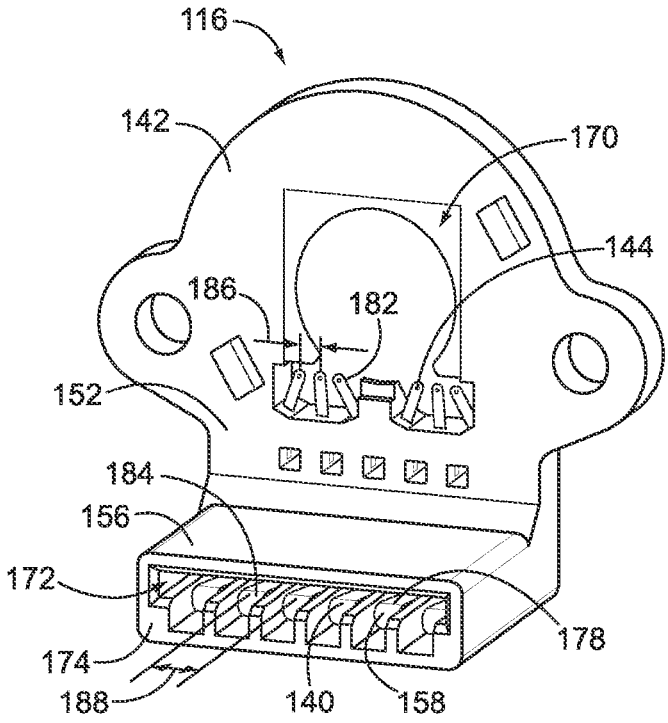
FIG. 7 is a bottom perspective view of the power connector shown in FIG. 5.
Figure 8:
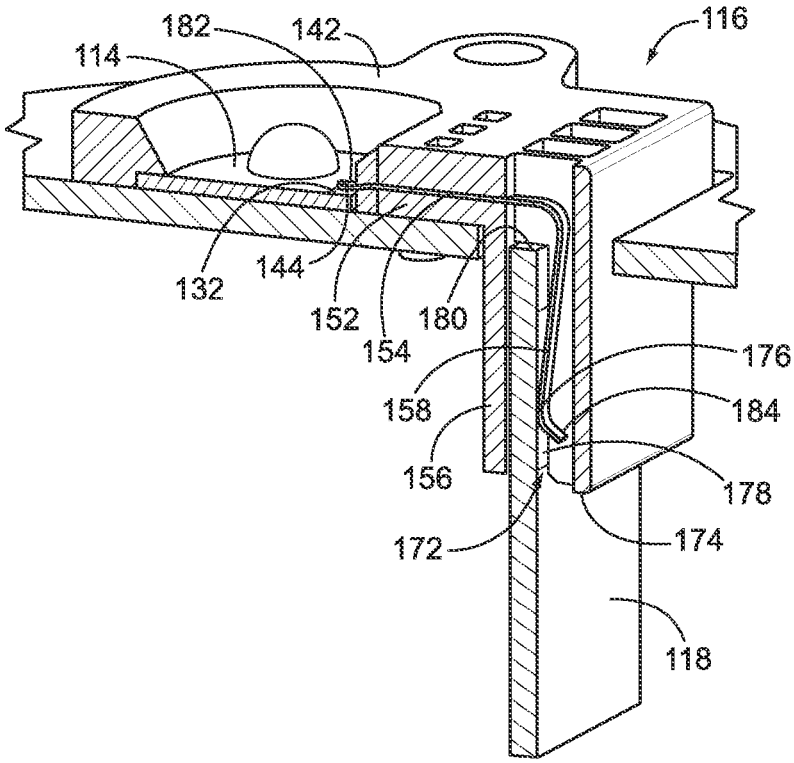
FIG. 8 is a partial cutaway view of the power connector shown in FIG. 5.

FIG. 7 is a bottom perspective view of the power connector 116. FIG. 8 is a partial cutaway view of the power connector 116. The upper portion 152 of the housing 142 includes a pocket 170 that receives the LED package 114 (shown in FIG. 8). The pocket 170 may be sized and shaped complementary to the size and shape of the LED package 114 to locate the housing 142 with respect to the LED package 114. For example, the edges of the mounting substrate 124 may engage the walls defining the pocket 170 to register the housing 142 with respect to the LED package 114. As such, the separable interfaces 144 of the power contacts 140 are properly aligned with the power leads 132 (shown in FIG. 8).

The lower portion 156 of the housing 142 includes a port 172 open at a bottom 174 of the housing 142. The second mating portions 158 are exposed within the port 172 and include mating interfaces 176 that are configured to mate with corresponding power conductors 178 of the power supply connector 118 (both shown in FIG. 8). In the illustrated embodiment, the lower portion 152 defines a card edge connector configured to receive an edge 180 of the power supply connector 118. The power supply connector 118 represents a PCB having power pads defining the power conductors 178. The second mating portions 158 engage corresponding power pads to define a power path to supply power from the power supply connector 118 to the power connector 116. Optionally, the second mating portions 158 are complaint beams that are deflectable within the port 172. The second mating portions 158 are biased against the power conductors 178 to ensure good electrical contact therebetween.

The power contacts 140 have first mating ends 182 and second mating ends 184. Optionally, the first mating ends 182 may be clustered together in more than one group. The first mating ends 182 within each group are separated by a first pitch 186 for contacting the power leads 132. The second mating ends 184 may be arranged in a different pattern than the first mating ends 182. For example, the second mating portions 158 may be parallel to one another and equally spaced apart by a second pitch 188 different from the first pitch 186. The second mating portions 158 may be sized differently than the first mating portions 152. The first mating ends 182 may include a protrusion or button that is curved to define a point of contact with the corresponding power lead 132.

Figure 9:
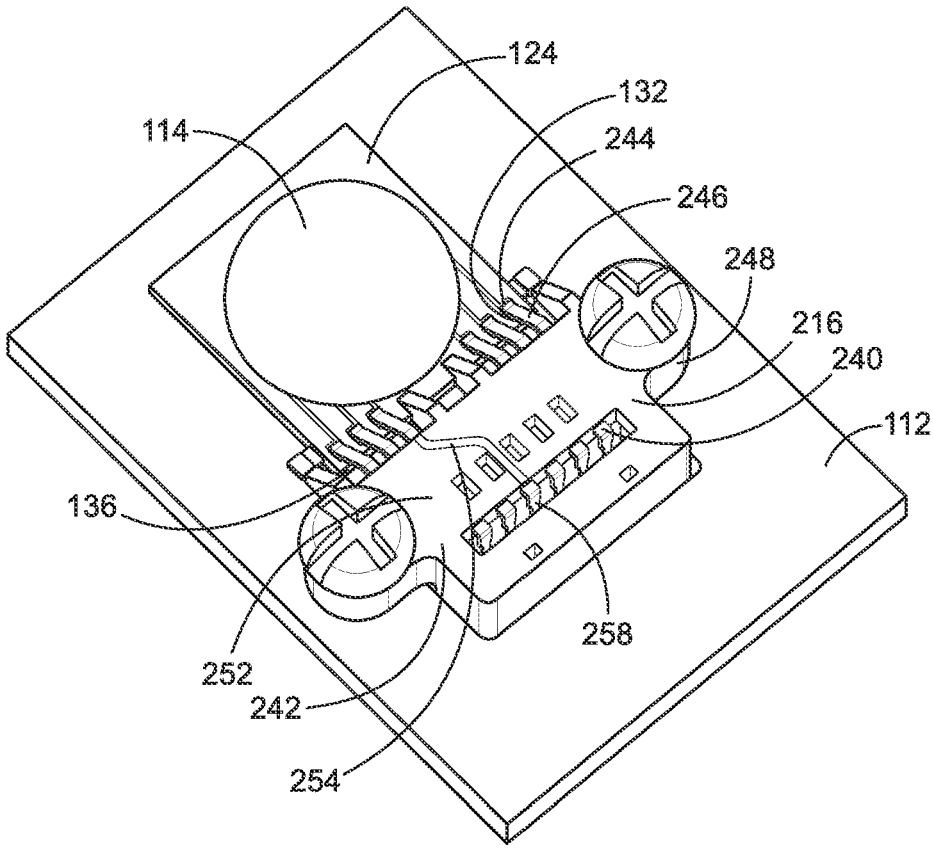
FIG. 9 a top perspective view of an alternative power connector mounted to the LED package.
Figure 10:
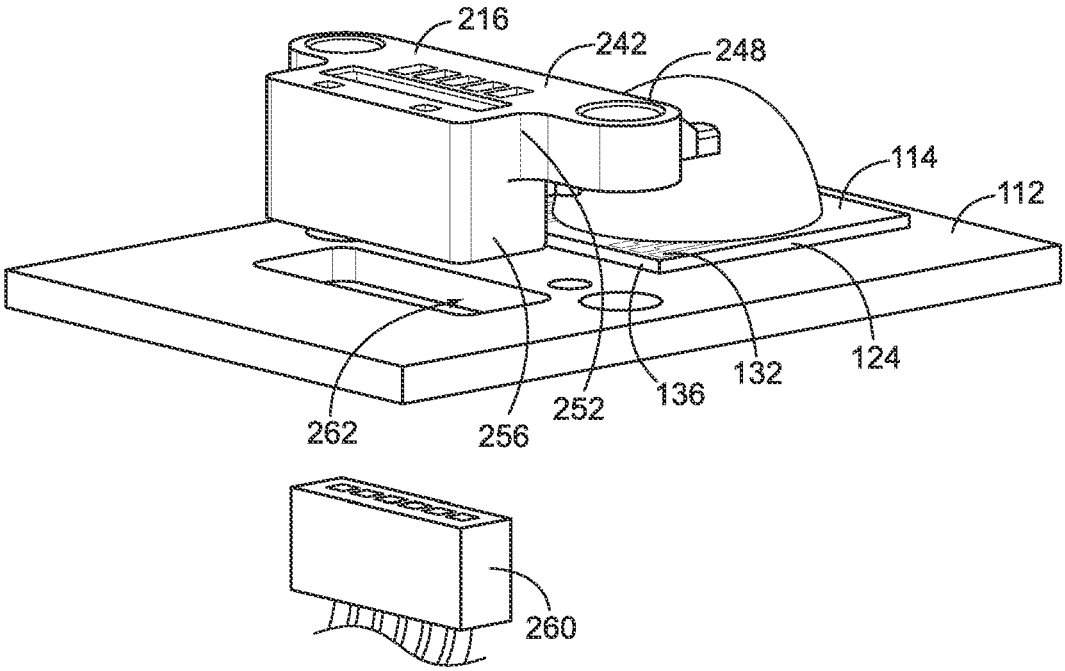
FIG. 10 is an exploded view of the power connector shown in FIG. 9.

FIG. 9 a top perspective view of an alternative power connector 216 mounted to the LED package 114. FIG. 10 is an exploded view of the power connector 216. The power connector 216 includes power contacts 240 held within a dielectric housing 242. In an exemplary embodiment, the housing 242 is overmolded over the power contacts 240. The power contacts 240 define separable interfaces 244 for contacting the power leads 132 on the mating substrate 124 of the LED package 114. The power contacts 240 supply power to the LED package 114 and the corresponding LED chips 130 (shown in FIGS. 3 and 4). The power contacts 240 include compliant beams 246 extending to the separable interfaces 244. The housing 242 includes mounting features 248 for securing the housing 242 to the base 112 independent of the LED package 114. In the illustrated embodiment, the base 112 is rectangular shaped rather than circular shaped.

The housing 242 is sized and shaped differently than the housing 142 (shown in FIGS. 5-8). The housing 242 includes an upper portion 252 holding a first mating portion 254 of each power contact 240. The housing 242 also includes a lower portion 256 holding a second mating portion 258 of each power contact 240. The upper portion 252 is secured to the base 112 adjacent the LED package 114. In contrast to the housing 142, the upper portion 252 does not surround the LED package 114, but rather is positioned on the edge 136 of the LED package 114 that has the power leads 132. The lower portion 256 extends from the upper portion 252 through an opening 262 in the base 112. The lower portion 256 is shaped differently than the housing 142, such as to mate with a different type of power supply connector 260. In the illustrated embodiment, the power supply connector 260 is represented by a cable mounted plug that is mated with the lower portion 256 of the housing 242. The lower portion 256 is exposed beneath the base 112, such that the power supply connector 260 is mated with the lower portion 256 beneath the base 112.

Figure 11:
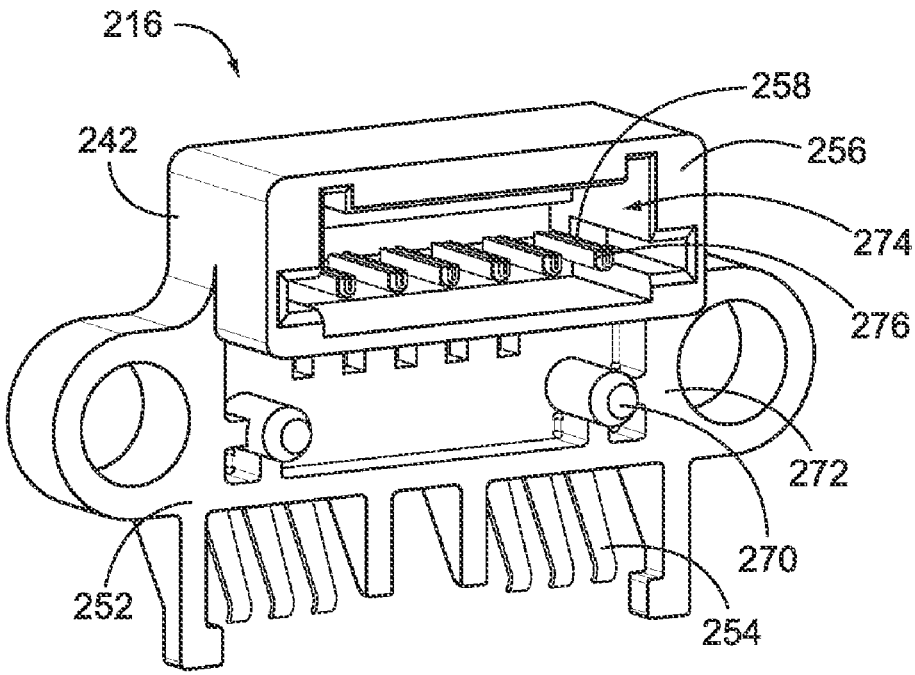
FIG. 11 is a bottom perspective view of the power connector shown in FIG. 9.

FIG. 11 is a bottom perspective view of the power connector 216. The upper portion 252 of the housing 242 includes locating pegs 270 that locate the housing 242 with respect to the base 112 (shown in FIGS. 1 and 2). The pegs 270 extend from a bottom 272 of the upper portion 252. The lower portion 256 also extends from the bottom 272 of the upper portion 252. The lower portion 256 includes a port 274 and the second mating portions 258 are exposed within the port 274. The second mating portions 258 include mating interfaces 276 that are configured to mate with corresponding power conductors of the power supply connector 260 (shown in FIG. 10). In the illustrated embodiment, the lower portion 256 defines a receptacle configured to receive the power supply connector 260. The second mating portions 258 are pins or posts that are received in socket-type contacts of the power supply connector 260. The pins may be formed by rolling or folding the second mating portions 258 into an O or U shape.

Figure 12:
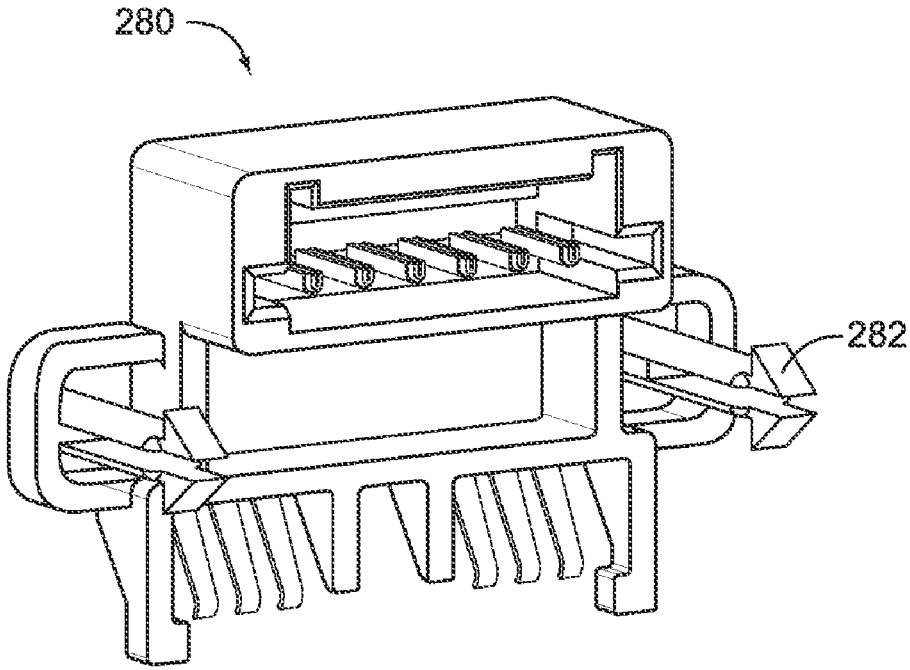
FIG. 12 is a bottom perspective view of an alternative power connector.

FIG. 12 is a bottom perspective view of an alternative power connector 280. The power connector 280 is similar to the power connector 216, however the power connector 280 includes different mounting features 282 than the mounting features 248 (shown in FIG. 9-10). The mounting features 282 represent split post latches configured to extend through the base 112 (shown in FIGS. 1 and 2). The latches engage the bottom of the base 112 to hold the power connector 280 against the base 112.

Figure 13:
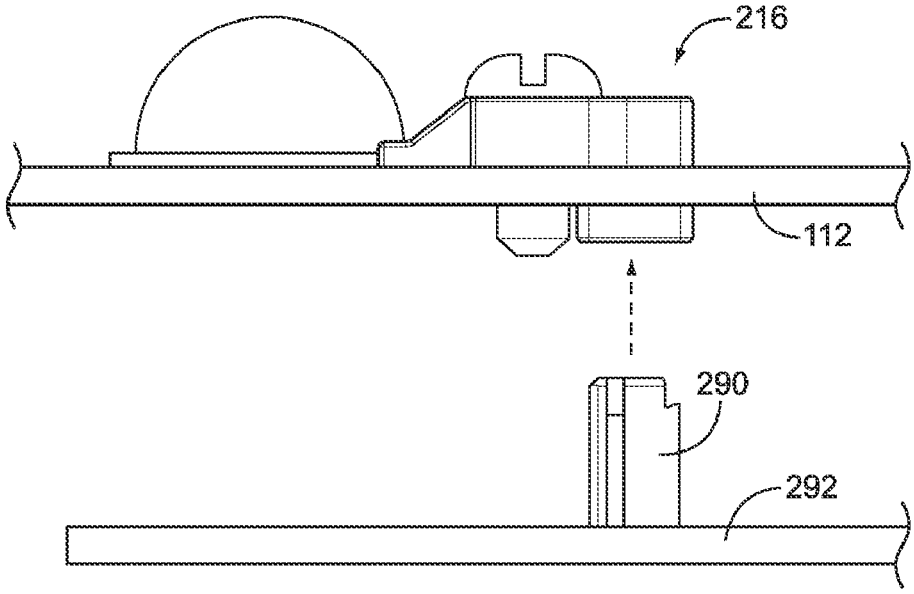
FIG. 13 is a side view of the power connector shown in FIG. 9 being mated with a power supply connector.
Figure 14:
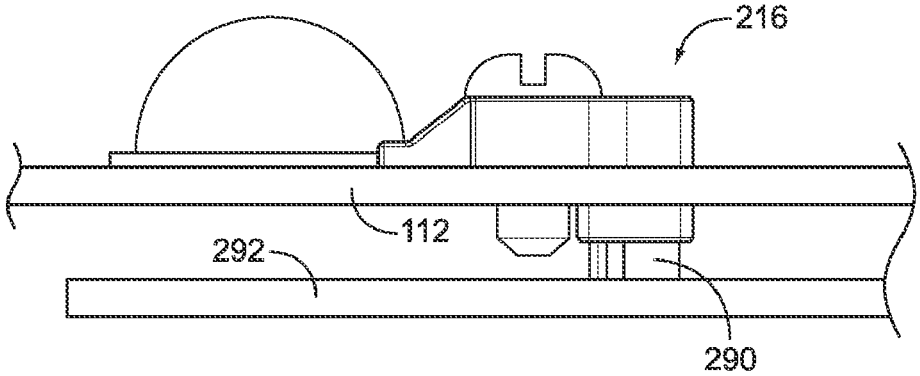
FIG. 14 is a side view of the power connector and the power supply connector in a mated state.

FIG. 13 is a side view of the power connector 216 being mated with an alternative power supply connector 290. FIG. 14 is a side view of the power connector 216 and the power supply connector 290 in a mated state. The power supply connector 290 represents a board mounted header. The header has the same form factor as the plug of the power supply connector 260, however, it is board mounted to a PCB 292 rather than cable mounted. The PCB 292 represents a driver board configured to supply power to the power connector 216 according to a control scheme. For example, the PCB 292 may supply power to one of the three LED chips, more than one of the LED chips, or none of the LED chips, based on the particular control scheme. The arrangement constitutes a mezzanine type connection, with the PCB 292 being arranged parallel to the base 112. When the power connector 216 and power supply connector 290 are mated, the base 112 and PCB 292 are in close proximity to one another, having a low profile.

Figure 15:
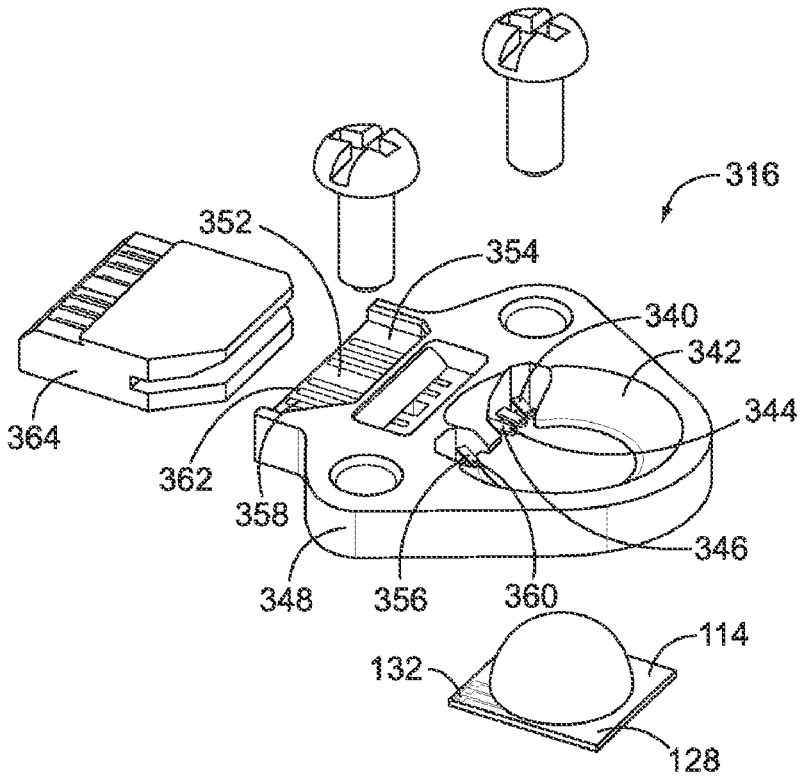
FIG. 15 is an exploded view of an alternative power connector.
Figure 16:
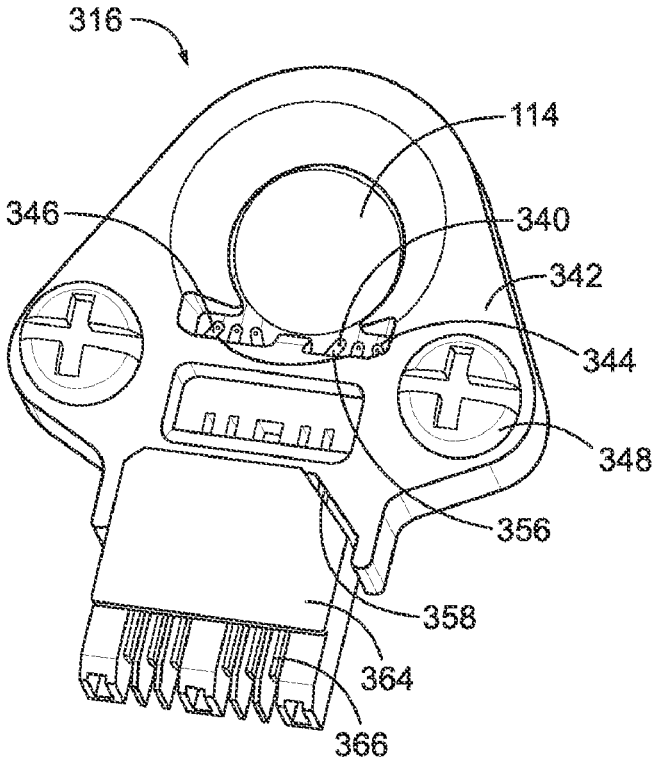
FIG. 16 is an assembled view of the power connector shown in FIG. 15.

FIG. 15 is an exploded view of an alternative power connector 316. FIG. 16 is an assembled view of the power connector 316. The power connector 316 includes power contacts 340 held within a dielectric housing 342. In an exemplary embodiment, the housing 342 is overmolded over the power contacts 340. The power contacts 340 define separable interfaces 344 for contacting the power leads 132 on the mating substrate 124 of the LED package 114. The power contacts 340 supply power to the LED package 114. The power contacts 340 include compliant beams 346 extending to the separable interfaces 344. The housing 342 includes mounting features 348 for securing the housing 342 to the base 112 independent of the LED package 114.

The housing 342 includes a mating tongue 352 along an outer surface thereof. The power contacts 340 are exposed on a surface 354 of the mating tongue 352. The power contacts 340 extend between a first mating portion 356 and a second mating portion 358. The first mating portion 356 has a first mating end 360 defining the separable interface 344, and is configured to engage the power leads 132. The second mating portion 358 has a second mating end 362 at the opposite end of the power contact 340. The second mating portions 358 are exposed on the surface 354 of the mating tongue 352. The mating tongue 352 is configured to be coupled to a power supply connector 364, represented by a card edge connector. The power supply connector 364 has mating contacts 366 defining the power conductors. The power contacts 340 are configured to engage corresponding mating contacts 366 when the card edge connector is mated to the mating tongue 352.

Figure 17:
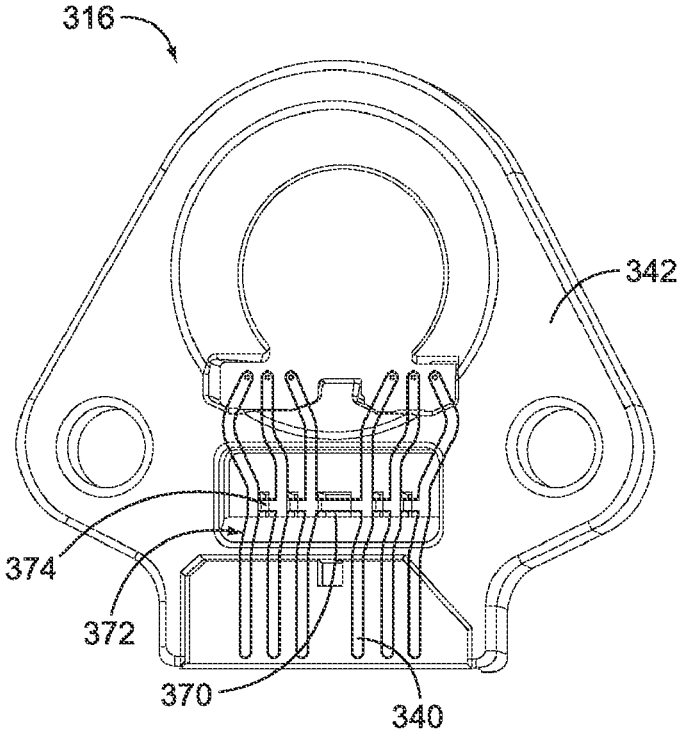
FIG. 17 is a top view of the power connector shown in FIG. 15 in a first state of manufacture.
Figure 18:
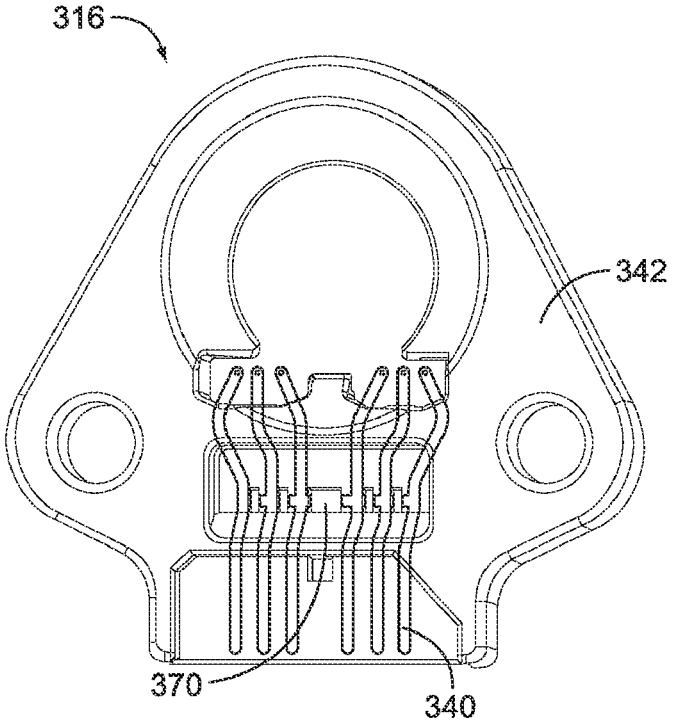
FIG. 18 is a top view of the power connector shown in FIG. 15 in a second state of manufacture.

FIG. 17 is a top view of the power connector 316 in a first state of manufacture. FIG. 18 is a top view of the power connector 316 in a second state of manufacture. The housing 342 includes punch-out windows 370. The punch-out windows 370 are configured to receive a tool (not shown) that removes portions of the power contacts 340. In an exemplary embodiment, the power contacts 340 are stamped and formed as part of a lead frame 372, wherein each of the power contacts 340 are integrally formed from a common sheet of metal material. The power contacts 340 remain attached to one another during manufacture of the housing 342 by connecting pieces 374. During the first state of manufacture, the housing 342 is overmolded over the power contacts 340. By having the power contacts 340 connected to one another during the overmolding process, the relative positions of the power contacts 340 with respect to one another and with respect to the housing 342 may be accurately maintained. After the housing 342 is formed, the power contacts 340 need to be separated from one another to define discrete power contacts 340. During the second state of manufacture, the tool is inserted into the punch-out windows 370 and the connecting pieces 374 that connect the power contacts 340 are removed, thus isolating the power contacts 340 from one another. FIG. 18 shows the power contacts 340 after the connecting pieces 374 have been removed, thus defining discrete power contacts 340.

Figure 19:
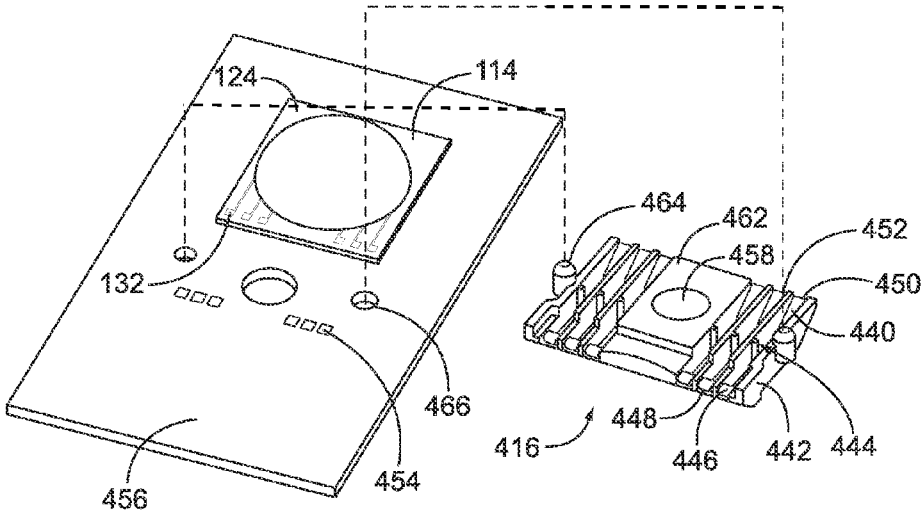
FIG. 19 illustrates another alternative power connector in an unmated state with the LED package.
Figure 20:
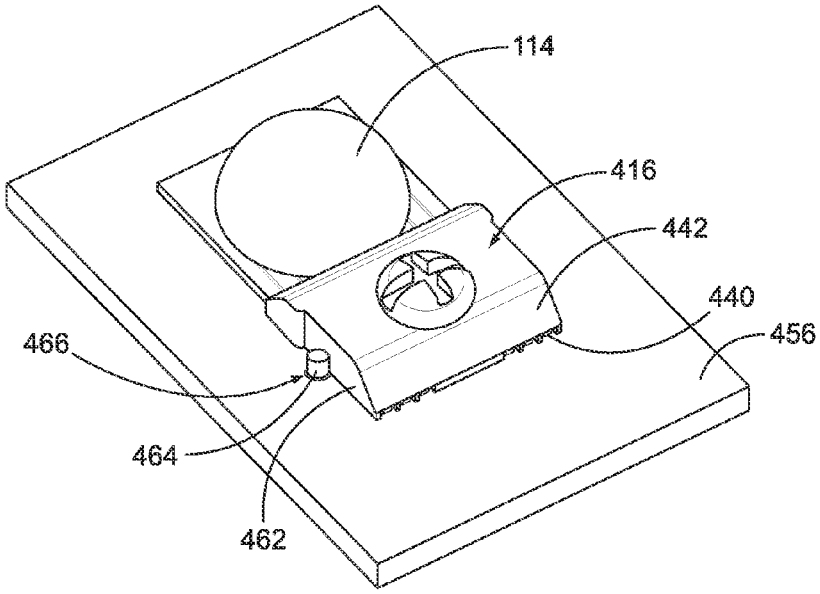
FIG. 20 is a top perspective view of the power connector shown in FIG. 19 in a mated state.

FIG. 19 illustrates another alternative power connector 416 in an unmated state with the LED package 114. The bottom of the power connector 416 is shown in FIG. 19. FIG. 20 is a top perspective view of the power connector 416 in a mated state with the LED package 114.

The power connector 416 represents a jumper connector having power contacts 440 held within a dielectric housing 442. In an exemplary embodiment, the housing 442 includes channels 444 formed therein that receive the power contacts 440 therein. Each power contact 440 has a first separable interface 446 at a first mating end 448 thereof and a second separable interface 450 at a second mating end 452 thereof. The first separable interface 446 is positioned for contacting the power leads 132 on the mating substrate 124 of the LED package 114. The second separable interface 446 is positioned for contacting a power conductor 454 on the base 456. The base 456 differs from the base 112 (shown in FIGS. 1 and 2) in that the base 456 is a PCB having power pads representing the power conductors 454 for supplying power to the power connector 416. The power contacts 440 supply power to the LED package 114 from the power conductors 454. The power contacts 440 have compliant beams at both mating ends 448, 452. The housing 442 includes a mounting feature 458 for securing the housing 442 to the base 112 independent of the LED package 114. The mounting feature 458 is represented by an opening that receives a fastener. Other types of mounting features may be used in alternative embodiments.

The housing 442 includes a bottom 462 that rests upon the base 456. Locating posts 464 extend from the bottom 462 and are received in corresponding openings 466 in the base 456 for locating the power connector 416 relative to the LED package 114. Optionally, the locating posts 464 may be of different sizes to orient the housing 442 with respect to the base 456 and LED package 114. The openings 466 in the base 456 may also be of different sizes to receive the corresponding locating posts 464. The separable interfaces 446, 450 are exposed at the bottom 462 for engaging the power leads 132 and power conductors 454, respectively.

Figure 21:
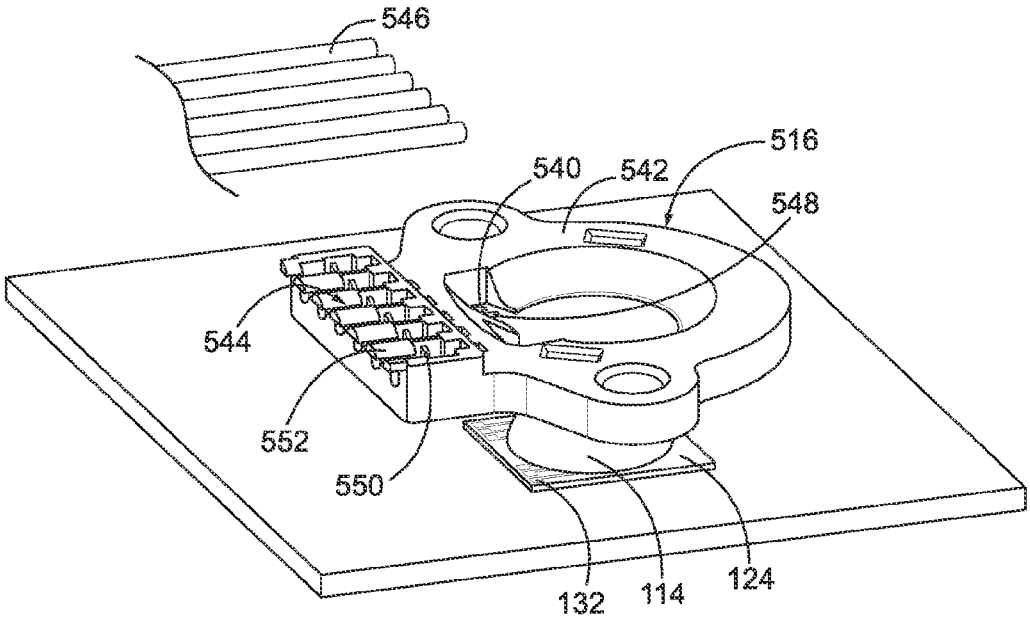
FIG. 21 is an exploded view of yet another alternative power connector.
Figure 22:
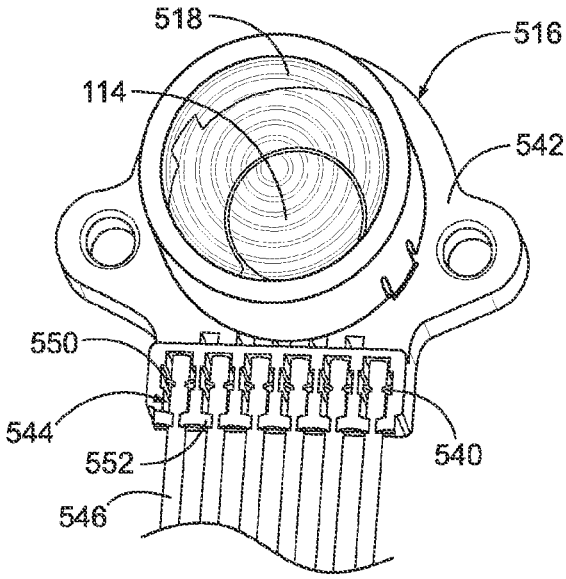
FIG. 22 is a top perspective view of the power connector shown in FIG. 21 with a lens coupled thereto.

FIG. 21 is an exploded view of yet another alternative power connector 516. FIG. 22 is a top perspective view of the power connector 516 in an assembled state with a lens 518 coupled thereto. The power connector 516 includes power contacts 540 held within a dielectric housing 542. The housing 542 includes wire slots 544 formed therein that receive individual power supply wires therein. The power supply wires represent power conductors 546 for supplying power to the power connector 516.

Each power contact 540 has a first separable interface 548 and an insulation displacement contact (IDC) 550 at the opposite end thereof. The first separable interface 548 is positioned for contacting the power leads 132 on the mating substrate 124 of the LED package 114. The IDC 550 is positioned for contacting the power conductor 546. For example, the power supply wires are loaded into the wire slots 544 and terminated to the IDCs 550. The wire slots 544 include clips 552 that hold the power supply wires in the wire slots 544. The housing 542 includes mounting features 558 for securing the housing 542 to the base 112 independent of the LED package 114.

Figure 23:
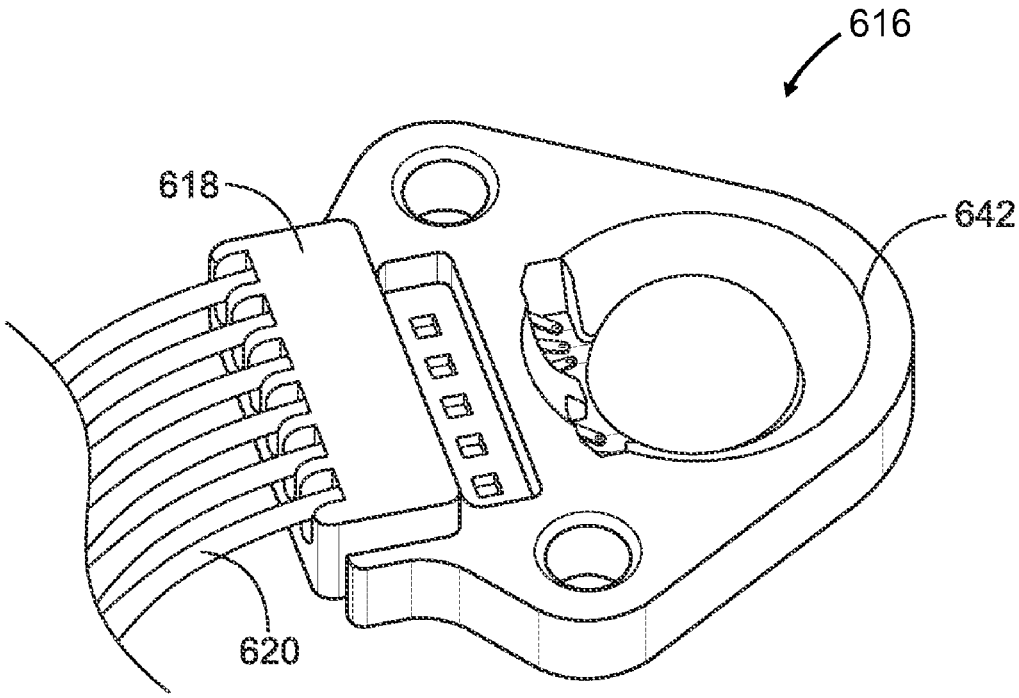
FIG. 23 is a top perspective view of another alternative power connector with a stuffer mounted thereto.
Figure 24:
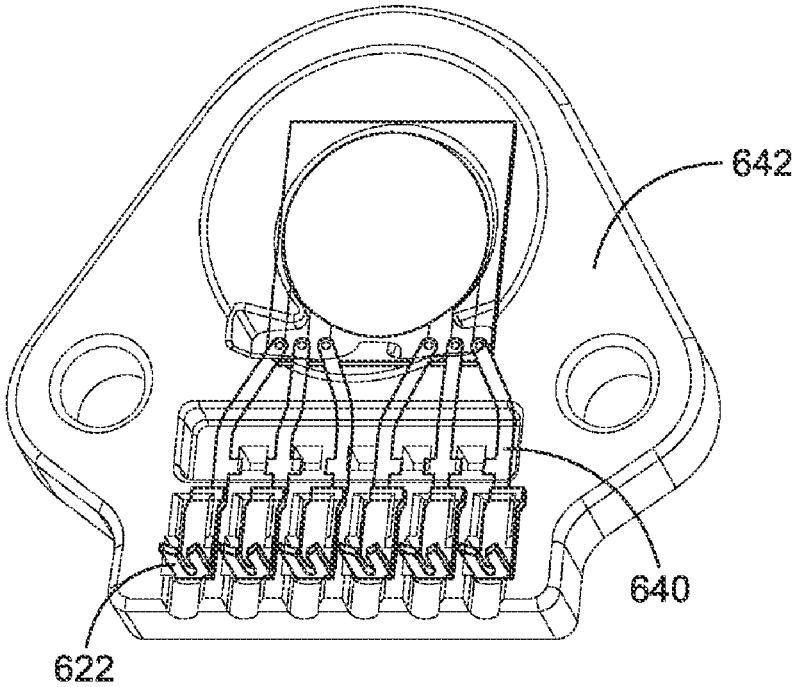
FIG. 24 is a top perspective view of the power connector shown in FIG. 23 without the stuffer.

FIG. 23 is a top perspective view of another alternative power connector 616 with a stuffer 618 mounted thereto. FIG. 24 is a top perspective view of the power connector 618 without the stuffer 618. The power connector 616 is similar to the power connector 516 (shown in FIGS. 21-22), however the stuffer 618 is used to simultaneously terminate the power supply wires 620 to IDCs 622 of the power connector 616. The IDCs 622 are integrally formed with power contacts 640 and held by a housing 642.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A lighting assembly comprising:

a base having a top surface and a bottom surface;

an LED package mounted to the base, the LED package comprising a mounting substrate and an LED chip on a top of the mounting substrate, the mounting substrate having power leads on the top of the mounting substrate arranged proximate to a first edge of the mounting substrate;

power contacts defining separable interfaces for contacting the power leads on the mounting substrate of the LED package and supplying power to the LED chip, the power contacts having compliant beams extending to the separable interfaces, the compliant beams being deflected when contacting the power leads such that the power contacts are biased against the power leads, the power contacts being terminated to corresponding power conductors opposite the separable interfaces; and a dielectric housing holding the power contacts, the housing having mounting features for securing the housing to the base independent of the LED package.

2. The assembly of claim 1, wherein the separable interfaces of the power contacts are arranged in a row on one side of the LED package to contact the power leads at the first edge of the mounting substrate.

3. The assembly of claim 1, wherein the power contacts are grouped in first and second groups, each group having a plurality of power contacts, the first group defining anode power contacts supplying a positive voltage to the corresponding power leads, the second group defining cathode power contacts supplying negative voltage to the corresponding power leads, each anode power contact being configured to contact a discrete power lead, each cathode power contact being configured to contact a discrete power lead.

4. The assembly of claim 1, wherein the LED package has a plurality of LED chips configured to emit a different color, the power leads being connected to a corresponding LED chip, the power contacts being configured to contact corresponding discrete power leads, the power contacts being selectively powered by the corresponding power conductor to control a lighting scheme of the lighting assembly.

5. The assembly of claim 1, wherein the power contacts have first mating ends and second mating ends, the first mating ends being separated by a first pitch for contacting the power leads, the second mating ends being separated by a second pitch different from the first pitch.

6. The assembly of claim 1, wherein the housing is overmolded over the power contacts, wherein portions of the contacts are exposed for mating with the power leads and the power conductors.

7. The assembly of claim 1, wherein the power contacts are bent at a right angle defining a first mating portion and a second mating portion generally perpendicular to the first mating portion, the second mating portion extending through the base to terminate to the power conductors below the base.

8. The assembly of claim 1, wherein the base includes a printed circuit board (PCB) having power pads on a top surface thereof, the LED package being mounted to the top surface of the PCB proximate to the power pads, the housing being coupled to the base such that the power contacts contact the power leads and the power pads.

9. The assembly of claim 1, wherein the power contacts each have a first mating portion and a second mating portion, the first mating portions defining separable interfaces, the second mating portions having insulation displacement contacts (IDCs) for terminating to the power conductors of power supply wires.

10. The assembly of claim 1, further comprising a stuffer removably coupled to the housing, the stuffer receiving a plurality of power supply wires therein, the wires defining the power conductors, the power contacts having insulation displacement contacts (IDCs) for terminating to the power conductors of the power supply wires.

11. The assembly of claim 1, wherein the housing includes an upper portion holding a first mating portion of each power contact and a lower portion holding a second mating portion of each power contact, the upper portion being secured to the base adjacent the LED package, the lower portion extending from the upper portion through an opening in the base, the lower portion having a port with the second mating portions exposed therein, the lower portion defining a card edge connector configured to receive an edge of a printed circuit board having power pads defining the power conductors, the second mating portions being configured to engage corresponding power pads.

12. The assembly of claim 1, wherein the housing includes an upper portion holding a first mating portion of each power contact and a lower portion holding a second mating portion of each power contact, the upper portion being secured to the base adjacent the LED package, the lower portion extending from the upper portion through an opening in the base, the lower portion having a port with the second mating portions exposed therein, the lower portion being configured to receive a plug therein having mating contacts defining the power conductors, the second mating portions being configured to engage corresponding mating contacts.

13. The assembly of claim 1, wherein the housing includes a mating tongue, the power contacts being exposed on a surface of the mating tongue, the mating tongue being configured to be coupled to a card edge connector having mating contacts defining the power conductors, the power contacts being configured to engage corresponding mating contacts when the card edge connector is mated to the mating tongue.

14. A lighting assembly for a light emitting diode (LED) package having an LED chip on a top of a mounting substrate with power leads on the top of the mounting substrate arranged proximate to a first edge of the mounting substrate, the mounting substrate being mounted to a base, the lighting assembly comprising:

power contacts each having a first mating portion and a second mating portion, the first mating portion defining a separable interface for contacting a corresponding power lead on the mating substrate of the LED package and supplying power to the LED chip, the second mating portion being terminated to a corresponding power conductor opposite the separable interface; and a dielectric housing holding the power contacts, the housing having an upper portion holding the first mating portions of the power contacts and a lower portion holding the second mating portions of the power contacts, the upper portion being secured to the base adjacent the LED package, the lower portion extending from the upper portion through an opening in the base, the lower portion having a port being configured to receive the power conductors for mating with the second mating portions of the power contacts.

15. The assembly of claim 14, wherein the port and second mating contacts define a card edge connector configured to receive an edge of a printed circuit board (PCB), the PCB having power pads defining the power conductors, the second mating portions being configured to engage corresponding power pads.

16. The assembly of claim 14, wherein the lower portion is configured to receive a plug in the port, the plug includes mating contacts defining the power conductors, the second mating portions being configured to engage corresponding mating contacts.

17. The assembly of claim 14, wherein the housing defines a right angle assembly with the first mating portion being oriented generally perpendicular to the second mating portion.

18. A lighting assembly for a light emitting diode (LED) package having an LED chip on a top of a mounting substrate with power leads on the top of the mounting substrate arranged proximate to a first edge of the mounting substrate, the mounting substrate being mounted to a base, the lighting assembly comprising:

power contacts each having a first mating portion and a second mating portion, the first mating portions defining separable interfaces for contacting corresponding power leads on the mating substrate of the LED package and supplying power to the LED chip, the first mating portions having compliant beams extending to the separable interfaces, the compliant beams being deflected when contacting the power leads such that the power contacts are biased against the power leads, the second mating portions having insulation displacement contacts (IDCs) for terminating to corresponding power conductors of power supply wires; and a dielectric housing holding the power contacts, the housing having mounting features for securing the housing to the base independent of the LED package.

19. The assembly of claim 18, further comprising a stuffer removably coupled to the housing, the stuffer receiving the power supply wires therein, the IDCs being terminated to the power conductors of the power supply wires when the stuffer is mated with the housing.

20. The assembly of claim 18, wherein the housing includes wire slots aligned with each of the IDCs, the wire slots being configured to securely hold the power supply wires therein.

* * * * *